US008044016B2

(12) United States Patent
Warkotsch et al.

(10) Patent No.: US 8,044,016 B2
(45) Date of Patent: Oct. 25, 2011

(54) ANTI-GREY DETERGENT COMPRISING A POLYCARBONATE-, POLYURETHANE-, AND/OR POLYUREA-POLYORGANOSILOXANE COMPOUND

(75) Inventors: Nadine Warkotsch, Duesseldorf (DE); Birgit Middelhauve, Monheim (DE); Marc-Steffen Schiedel, Duesseldorf (DE); Thomas Eiting, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 69 days.

(21) Appl. No.: 12/572,634

(22) Filed: Oct. 2, 2009

(65) Prior Publication Data

US 2010/0022428 A1 Jan. 28, 2010

Related U.S. Application Data

(63) Continuation of application No. PCT/EP2008/053994, filed on Apr. 3, 2008.

(30) Foreign Application Priority Data

| | | |
|---|---|---|
| Apr. 3, 2007 | (DE) | 10 2007 016 382 |
| May 21, 2007 | (DE) | 10 2007 023 872 |
| Aug. 14, 2007 | (DE) | 10 2007 038 451 |

(51) Int. Cl.
*C11D 9/36* (2006.01)
*C11D 1/83* (2006.01)

(52) U.S. Cl. ..... 510/427; 510/276; 510/289; 510/290; 510/351; 510/356; 510/357; 510/426; 510/466

(58) Field of Classification Search ..... 510/276, 510/289, 290, 351, 356, 357, 426, 427, 466
See application file for complete search history.

(56) References Cited

U.S. PATENT DOCUMENTS

| | | | | |
|---|---|---|---|---|
| 3,367,920 | A | 2/1968 | Wasserman et al. | |
| 3,893,929 | A | 7/1975 | Basadur | |
| 4,000,093 | A | 12/1976 | Nicol et al. | |
| 4,116,885 | A | 9/1978 | Derstadt et al. | |
| 4,136,038 | A | 1/1979 | Pracht et al. | |
| 4,174,305 | A | 11/1979 | Burns et al. | |
| 4,201,824 | A | 5/1980 | Lagasse et al. | |
| 4,664,839 | A | 5/1987 | Rieck | |
| 5,534,182 | A | 7/1996 | Kirk et al. | |
| 5,622,926 | A | 4/1997 | Schade et al. | |
| 5,643,581 | A * | 7/1997 | Mougin et al. | 424/401 |
| 6,395,265 | B1 * | 5/2002 | Mougin et al. | 424/70.12 |
| 2003/0158064 | A1 | 8/2003 | Kessler et al. | |
| 2003/0198819 | A1 * | 10/2003 | Reusmann et al. | 428/447 |
| 2004/0034911 | A1 | 2/2004 | Day | |
| 2007/0092656 | A1 * | 4/2007 | Keul et al. | 427/400 |
| 2008/0075683 | A1 * | 3/2008 | Herzig et al. | 424/70.12 |
| 2009/0232752 | A1 * | 9/2009 | Carson et al. | 424/59 |
| 2010/0011513 | A1 | 1/2010 | Warkotsch et al. | |
| 2010/0011519 | A1 | 1/2010 | Warkotsch et al. | |
| 2010/0016203 | A1 | 1/2010 | Warkotsch et al. | |
| 2010/0016206 | A1 | 1/2010 | Warkotsch et al. | |
| 2010/0022427 | A1 | 1/2010 | Warkotsch et al. | |
| 2010/0028270 | A1 * | 2/2010 | Nguyen-Kim | 424/47 |

FOREIGN PATENT DOCUMENTS

| | | | |
|---|---|---|---|
| DE | 1617141 | A1 | 10/1965 |
| DE | 2200911 | A1 | 1/1971 |
| DE | 2253063 | A1 | 10/1971 |
| DE | 2412837 | | 10/1974 |
| DE | 2655551 | A1 | 6/1977 |
| DE | 2846984 | A1 | 5/1979 |
| DE | 2857292 | A1 | 2/1980 |
| DE | 3324258 | A1 | 1/1984 |
| DE | 42 44 386 | A1 | 6/1994 |
| DE | 10037126 | A1 | 2/2002 |
| DE | 100 50 622 | A1 | 5/2002 |
| DE | 103 57 232 | B3 | 6/2005 |
| EP | 0164514 | A1 | 11/1984 |
| EP | 0 185 427 | | 6/1986 |
| EP | 0 213 739 | A2 | 3/1987 |
| EP | 0 300 305 | A2 | 7/1987 |
| EP | 0 241 984 | A2 | 10/1987 |
| EP | 0 241 985 | A2 | 10/1987 |
| EP | 0 213 729 | | 11/1987 |
| EP | 0 213 730 | | 11/1987 |
| EP | 2 53 567 | A1 | 1/1988 |
| EP | 0 271 312 | A2 | 6/1988 |
| EP | 2 72 033 | A2 | 6/1988 |
| EP | 0 274 907 | A1 | 7/1988 |
| EP | 357280 | A2 | 3/1990 |
| EP | 0 634 486 | A1 | 1/1995 |
| EP | 1 541 568 | A1 | 6/2005 |
| GB | 1154730 | | 6/1969 |
| GB | 1377092 | | 12/1974 |
| GB | 2007692 | A | 5/1979 |
| GB | 1578930 | | 11/1980 |
| GB | 2165856 | | 4/1986 |
| WO | WO-97/09369 | A | 3/1997 |
| WO | WO 99/41347 | | 8/1999 |
| WO | WO 00/77138 | A1 | 12/2000 |
| WO | WO-03/035712 | A1 | 5/2003 |
| WO | WO 03/042264 | A2 | 5/2003 |
| WO | WO 03/095530 | A1 | 11/2003 |
| WO | WO 2005/042684 | A1 | 5/2005 |
| WO | WO 2005/058863 | A1 | 6/2005 |
| WO | WO 2006/005358 | A1 | 1/2006 |
| WO | WO 2006/029794 | A1 | 3/2006 |
| WO | WO 2006/069742 | A1 | 7/2006 |
| WO | WO 2006/127882 | A2 | 11/2006 |

OTHER PUBLICATIONS

International Search Report for Priority Application PCT/EP2008/054003.

* cited by examiner

*Primary Examiner* — Charles Boyer
(74) *Attorney, Agent, or Firm* — RatnerPrestia

(57) ABSTRACT

The invention relates to a detergent which contains a surfactant and optionally further conventional additives of detergents and cleaning agents, the detergent comprising an anti-grey polycarbonate-, polyurethane- and/or polyurea-polyorganosiloxane compound or a precursor compound thereof containing specific reactive groups, which can be used for the production thereof.

11 Claims, No Drawings

ANTI-GREY DETERGENT COMPRISING A POLYCARBONATE-, POLYURETHANE-, AND/OR POLYUREA-POLYORGANOSILOXANE COMPOUND

CROSS-REFERENCE TO RELATED APPLICATIONS

This application is a continuation under 35 U.S.C. §§120 and 365(c) of International Application PCT/EP2008/053994, filed on Apr. 3, 2008, and published as WO 2008/119831 on Oct. 9, 2008. This application also claims priority under 35 U.S.C. §119 of DE 10 2007016382.9, filed Apr. 3, 2007, DE 10 2007023872.1, filed May 21, 2007, and DE 10 2007038451.5, filed Aug. 14, 2007. The disclosures of PCT/EP2008/053994, DE 10 2007016382.9, DE 10 2007023872.1, and DE 10 2007038451.5 are hereby incorporated by reference in their entirety for all purposes.

FIELD OF THE INVENTION

The invention relates to a detergent, which contains a surfactant and also contains as the anti-grey active ingredient a polycarbonate-, polyurethane- and/or polyurea-polyorganosiloxane compound or a precursor compound, which may be used in the production thereof with certain reactive groups.

The function of anti-grey compounds is to keep the dirt that is released from the fiber when washing textiles suspended in the washing liquid and thereby prevent redeposition of dirt on the textile. Water-soluble colloids, usually of an organic nature, are suitable for this purpose, e.g., glue, gelatin, salts of ether sulfonic acids of starch or of cellulose or salts of acidic sulfuric acid esters of cellulose or of starch. Water-soluble polyamides containing acid groups are also suitable for this purpose. In addition, soluble starch preparations and other starch products in addition to those mentioned above may also be used, e.g., degraded starch, aldehyde starches, etc. Polyvinyl pyrrolidone may also be used. Cellulose ethers such as carboxymethyl cellulose (sodium salt), methyl cellulose, hydroxyalkyl cellulose and mixed ethers such as methylhydroxyethyl cellulose, methylhydroxypropyl cellulose, methylcarboxymethyl cellulose and mixtures thereof in amounts of normally 0.1 to 5 wt %, based on the detergent are frequently also used.

Although the cellulose ethers mentioned above have a good anti-grey effect, there are such narrow limits to their use in water-based liquid detergents that in practice they cannot be incorporated into these detergents. In addition to their anti-grey effect, which is relevant only when used in a washing method, these cellulose ethers have a comparatively low solubility in surfactant-containing systems and have a strong thickening effect on aqueous systems. When incorporated into liquid detergents containing water and especially anionic surfactants in the desired concentrations for the anti-grey effect, the result is usually either products which are no longer free-flowing and pourable and which can be formulated to be easy to handle by the user only through additional effort, e.g., providing individual dosing portions, packaged in water-soluble packaging or in water-insoluble packaging that can be torn open; or the cellulose ethers do not dissolve completely in the water-based liquid detergent, in particular after storage, which leads not only to aesthetics that are perceived as being inadequate but also to inadequate dosing of the anti-grey active ingredient when the agent containing same is used.

BRIEF SUMMARY OF THE INVENTION

It has surprisingly now been found that a good anti-grey effect in water-based liquid detergents can be achieved without an unacceptable increase in viscosity or precipitation by using certain polycarbonate-, polyurethane- and/or polyurea-polyorganosiloxane compounds or precursor compounds of the reactive cyclic carbonate and urea type that may be used in the synthesis of such polycarbonate-, polyurethane- and/or polyurea-polyorganosiloxane compounds.

DETAILED DESCRIPTION OF CERTAIN EMBODIMENTS OF THE INVENTION

The subject matter of the invention is a detergent, in particular an aqueous liquid detergent containing a surfactant and optionally other conventional ingredients of detergents and cleaning agents, such that the agent contains an anti-grey polycarbonate-, polyurethane- and/or polyurea-polyorganosiloxane compound, comprising at least one structural element of Formula (I):

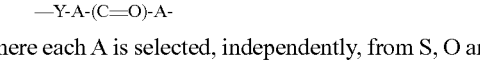

$$—Y-A-(C{=}O)-A- \quad (I)$$

where each A is selected, independently, from S, O and $NR^1$,

Y is selected from divalent to polyvalent, in particular tetravalent linear, cyclic or branched, saturated, unsaturated or aromatic, substituted or unsubstituted hydrocarbon radicals with up to 1000 carbon atoms (not counting the carbon atoms of a polyorganosiloxane unit that is optionally also included), which may contain one or more groups selected from —O—, —(CO)—, —NH—, —$NR^2$—, —($N^+R^2R^3$)— and a polyorganosiloxane unit with 2 to 1000 silicon atoms, $R^1$ is hydrogen or a linear, cyclic or branched, saturated, unsaturated or aromatic hydrocarbon radical with up to 40 carbon atoms, which may contain one or more groups selected from —O—, —(CO)—, —NH— and —$NR^2$—, $R^2$ is a linear, cyclic or branched, saturated, unsaturated or aromatic hydrocarbon radical with up to 40 carbon atoms, which may contain one or more groups selected from —O—, —(CO)— and —NH—, $R^3$ is a linear, cyclic or branched, saturated, unsaturated or aromatic hydrocarbon radical with up to 100 carbon atoms, which may contain one or more groups selected from —O—, —(CO)— and —NH— or is a divalent radical, which forms cyclic structures within the radical Y, or one or both radicals A vicinal to Y together with the radical Y between them may form a heterocyclic radical containing nitrogen, and not all the radicals A and/or Y and/or $R^1$ and/or $R^2$ and/or $R^3$ indicated in formula (I) must be the same in the entire compound, with the provision that at least one of the radicals Y in the entire compound is a polyorganosiloxane unit with 2 to 1000 silicon atoms or the acid addition compound and/or a salt thereof.

Compounds of general formula (I) can be obtained by reacting diisocyanates, bischloroformic acid esters and/or amides or phosgene with thiols, alcohols or amines containing the structural element Y. To obtain polymer structures, these starting compounds containing the structural element Y have at least two of the aforementioned functional groups. Compounds that are monofunctional but otherwise correspond to structural element Y may be considered as end groups.

Of preferred polycarbonate- and/or polyurethane-polyorganosiloxane compounds, there are those containing at least one structural element of formula (II) or (III):

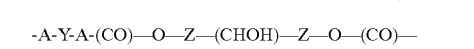

$$-A-Y-A-(CO)—O—Z—(CHOH)—Z—O—(CO)— \quad (II)$$

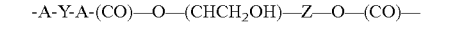

$$-A-Y-A-(CO)—O—(CHCH_2OH)—Z—O—(CO)— \quad (III)$$

in which A and Y have the meanings given above, and

Z is selected from the divalent, linear, cyclic or branched, saturated or unsaturated, optionally substituted hydrocarbon radicals with 1 to 12 carbon atoms. These structural elements can be obtained by ring opening of cyclic carbonates (carbonic acid esters of vicinal diols) with thiols, alcohols or amines containing the structural element Y.

The polycarbonate-, polyurethane- and/or polyurea-polyorganosiloxane compounds preferably contain the structural element of Formula (I) several times in succession, where the corresponding radicals A and/or Y and/or Z and/or $R^1$ and/or $R^2$ and/or $R^3$ which occur multiple times may be the same or different.

The term "acid addition compound" denotes a salt-like compound, which can be obtained by protonation of basic groups in the molecule, in particular the amino groups that are optionally present, e.g., by reaction with organic or inorganic acids. The acid addition compounds may be used as such or may optionally be formed under the conditions of use of the compounds defined above.

If the polycarbonate-, polyurethane- and polyurea-polyorganosiloxane compound contains —($N^+R^2R^3$)— groups, then conventional counter anions, e.g., halide, hydroxide, sulfate, carbonate are present in an amount sufficient to ensure charge neutrality.

The polyorganosiloxane structural element present in the polycarbonate-, polyurethane- and/or polyurea-polyorganosiloxane compounds is preferably the structure —$(SiR^4{}_2O)_p$—($SiR^4{}_2$)—, where $R^4$ is a linear, cyclic or branched, saturated, unsaturated or aromatic hydrocarbon radical with up to 20 carbon atoms, and p=1 to 999. The polycarbonate-, polyurethane- and polyurea-polyorganosiloxane compounds preferably contain on the average at least two, in particular at least three of the aforementioned polyorganosiloxane structural elements. $R^4$ is preferably a linear or cyclic or branched, saturated or unsaturated or aromatic $C_1$ to $C_{20}$, in particular $C_1$ to $C_9$ hydrocarbon radical, especially preferably methyl or phenyl, and p is in particular 1 to 199, especially preferably 1 to 99. In a preferred embodiment, all radicals $R^4$ are the same.

Preferred polycarbonate-, polyurethane- and/or polyurea-polyorganosiloxane compounds used according to the invention are linear, i.e., all Y units in the structural element of formula (I) are divalent radicals. However, branched compounds may also be covered by the present invention, in which at least one of the radicals Y is trivalent or polyvalent, preferably tetravalent, so that branched structures with linear repeating structures are formed from structural elements of formula (I).

In another embodiment, at least one of the Y units according to the structural element of formula (I) has a group —$NR^2$— and at least one of the Y units according to the structural element of formula (I) has a group —($N^+R^2R^3$)— in the polycarbonate-, polyurethane- and/or polyurea-polyorganosiloxane compound used according to the invention. $R^2$ and $R^3$ here are preferably methyl groups.

Another embodiment relates to the multiple regular occurrences of —O— groups in at least one of the units Y, $R^1$, $R^2$ and/or $R^3$ according to the structural element of formula (I), preferably in the form of oligoethoxy groups and/or oligopropoxy groups whereby their degrees of oligomerization are preferably in the range from 2 to 60.

In another preferred embodiment, oligoethyleneimine groups whose degrees of oligomerization are in the range of 10 to 150,000 are present in at least one of the units Y, $R^1$, $R^2$ and/or $R^3$ according to the structural element of formula (I).

Reactive cyclic carbonates and ureas, processes for synthesis of same and reaction of same with polymer substrates are described in International Patent Application WO 2005/058863. It has now surprisingly been found that not only are the polycarbonate- and/or polyurethane-polyorganosiloxane compounds of the type indicated above, which are accessible from same, good anti-grey compounds, but also the reactive cyclic carbonates and ureas themselves and/or the polymers obtainable from same by reaction with polymer substrates have the desired effect.

Another subject of the invention is therefore a detergent, in particular an aqueous liquid detergent containing a surfactant plus optionally additional conventional ingredients of detergents and cleaning agents, such that the agent contains an anti-grey compound of general formula IV or V:

IV

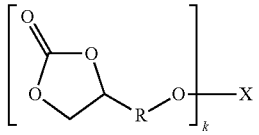

V

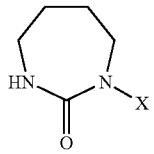

in which

R stands for $C_1$-$C_{12}$ alkylene k stands for a number greater than 0

X stands for CO—CH═$CH_2$, CO—C($CH_3$)—$CH_2$, CO—O-aryl, $C_2$-$C_6$-alkylene-$SO_2$—CH═$CH_2$ or CO—NH—$R^1$; and $R^1$ stands for $C_1$-$C_{30}$-alkyl, $C_1$-$C_{30}$-haloalkyl, $C_1$-$C_{30}$-hydroxyalkyl, $C_1$-$C_6$-alkyloxy-$C_1$-$C_{30}$-alkyl, $C_1$-$C_6$-alkylcarbonyloxy-$C_1$-$C_{30}$-alkyl, amino-$C_1$-$C_{30}$-alkyl, mono- or di($C_1$-$C_6$-alkyl)amino-$C_1$-$C_{30}$-alkyl, ammonio-$C_1$-$C_{30}$-alkyl, polyoxyalkylene-$C_1$-$C_{30}$-alkyl, polysiloxanyl-$C_1$-$C_{30}$-alkyl, (meth)acryloyloxy-$C_1$-$C_{30}$-alkyl, sulfono-$C_1$-$C_{30}$-alkyl, phosphono-$C_1$-$C_{30}$-alkyl, di($C_1$-$C_6$-alkyl)-phosphono-$C_1$-$C_{30}$-alkyl, phosphonato-$C_1$-$C_{30}$-alkyl, di($C_1$-$C_6$-alkyl)-phosphonato-$C_1$-$C_{30}$-alkyl or a saccharide radical, such that X in formula IV has this meaning only when k stands for 1, or X stands for (i) the radical of a polyamine to which the part of the formula in parentheses is bound via (CO)NH groups, or (ii) a polymer structure to which the formula part in parentheses is bound via (CO), NH—$C_2$-$C_6$-alkylene-O(CO) or (CO)—O—$C_2$-$C_6$-alkylene-O(CO) groups, or (iii) a polymer structure to which the formula part in parentheses is bound via (CO)-polysiloxanyl-$C_1$-$C_{30}$-alkyl groups, when k stands for a number greater than 1, and/or contains a polymer which is obtainable by reaction of a polymer substrate having functional groups, which are selected from hydroxyl groups, primary and secondary amino groups, with a compound of general formulas IV or V.

The polymer substrates suitable in conjunction with the aspect of the invention mentioned last include in particular polyvinyl alcohols, polyalkyleneamines, such as polyethyleneimines, polyvinylamines, polyallyl-amines, polyethylene glycols, chitosan, polyamide epichlorohydrin resins, polyaminostyrenes, polysiloxanes substituted with aminoalkyl groups in terminal position or as side groups, e.g., polydimethylsiloxanes, peptides, polypeptides and proteins as well as mixtures thereof. Especially preferred substrates are selected from polyethyleneimines with molecular weights in the range of 5000 to 100,000 in particular 15,000 to 50,000, compounds of formula $NH_2$—$[CH_2]_m$—$(Si(CH_3)_2O)_n$—$Si(CH_3)_2$—$[CH_2]_o$—R', where m=1 to 10, preferably 1 to 15, especially preferably 1 to 3, where n=1 to 50, preferably 30 to 50, where o=0 to 10 preferably 1 to 5, especially preferably 1 to 3 and where R'=H, $C_{1-22}$ alkyl, an amino group or an ammonium group and/or compounds of formula $NH_2$—$[CH(CH_3)$—$CH_2O]_l$—$[CH_2$—$CH_2O]_m$—$[CH_2$—$CH(CH_3)O]_n$—R" where l, m and n, independently of one another denote numbers from 0 to 50 with the provision that the sum l+m+n=5 to 100, in particular 10 to 50, preferably 10 to 30, especially preferably 10 to 20 and R"=H, a $C_{1-22}$ alkyl, $C_{1-22}$ aminoalkyl or $C_{1-22}$ ammonium alkyl group and mixtures thereof.

Of the polymers, those that are especially preferred are obtainable by reaction of the polymer substrate with a compound of general formula IV, where k=1, or general formula V. Also preferred are polymers obtainable by reaction of the polymer substrate with the same molar amounts of the compound of general formula IV, where k=1 or general formula V, based on the quantities of hydroxyl groups, primary and secondary amino groups contained therein.

The compound of formula IV is preferably selected from 4-phenyloxycarbonyloxymethyl-2-oxo-1,3-dioxolane, 4-(4-phenyloxycarbonyloxy)butyl-2-oxo-1,3-dioxolane, 2-oxo-1,3-dioxolan-4-yl-methyl acrylate, 2-oxo-1,3-d ioxolan-4-yl-methyl methacrylate, 4-(2-oxo-1,3-dioxolan-4-yl)butyl acrylate, 4-(2-oxo-1,3-dioxolan-4-yl)butyl methacrylate and 4-(vinylsulfonylethyloxy)butyl-2-oxo-1,3-dioxolane.

An inventive agent preferably contains 0.01 wt % to 5 wt %, in particular 0.1 wt % to 1 wt % of the anti-grey active ingredient described here (the polycarbonate-, polyurethane- and/or polyurea-polyorganosiloxane compound, the reactive cyclic carbonate or the reactive cyclic urea and/or the polymer obtainable from the latter by reaction with a polymer substrate).

The invention also relates to the use of these aforementioned active ingredients in detergents, in particular in aqueous liquid detergents, to improve the anti-grey effect in washing textile fabrics with the detergent.

In addition to the aforementioned anti-grey active ingredient or mixtures thereof and surfactants yet to be discussed below, the inventive liquid detergent also contains water in amounts (based on the total agent) of preferably up to approx. 85 wt % and in particular 40 wt % to 75 wt %, whereby this may, if desired, also be replaced proportionally by a water-soluble solvent component. Nonaqueous solvents that may be used in the liquid agents originate from the group of monovalent or polyvalent alcohols, alkanolamines or glycol ethers, for example, if they are miscible with water in the concentration range indicated. The solvents are preferably selected from ethanol, n-propanol or isopropanol, the butanols, ethylene glycol, butanediol, glycerol, diethylene glycol, butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl or propyl ether, dipropylene glycol monomethyl or ethyl ether, diisopropylene glycol monomethyl or ethyl ether, methoxy, ethoxy or butoxytriglycol, 1-butoxyethoxy-2-propanol, 3-methyl-3-methoxybutanol, propylene glycol tert-butyl ether and mixtures thereof. The amount of nonaqueous water-soluble solvent component, based on the total amount of the detergent and cleaning agent, is preferably up to 15 wt %, in particular 0.5 wt % to 10 wt %.

The inventive detergents contain at least one surfactant, wherein anionic, nonionic, cationic and/or amphoteric surfactants may be used. The presence of anionic surfactants is preferred, mixtures of anionic and nonionic surfactants being especially advantageous from the standpoint of applications. The total surfactant content of the agent, which is liquid in particular, is preferably in the range from 10 wt % to 60 wt %, in particular 15 wt % to 50 wt %, each based on the total liquid agent.

Preferably alcohol alkoxylates, i.e., alkoxylated, advantageously ethoxylated, in particular primary alcohols, preferably with 8 tol 8 carbon atoms and an average of 1 to 12 moles of ethylene oxide (EO) per mole of alcohol, in which the alcohol radical may be linear or preferably methyl-branched in position 2 and/or may contain linear and methyl-branched radicals in the mixture, such as those usually occurring in oxo alcohol radicals, are preferred for use as the nonionic surfactants. In particular, however, alcohol ethoxylates with linear radicals from alcohols of native origin with 12 to 18 carbon atoms, e.g., from coconut, palm, tallow fat or oleyl alcohol and with an average of 2 to 8 EO per mole alcohol are preferred in particular. The preferred ethoxylated alcohols include, for example, $C_{12-14}$ alcohols with 3 EO, 4 EO or 7 EO, $C_{9-11}$ alcohols with 7 EO, $C_{13-15}$ alcohols with 3 EO, 5 EO, 7 EO or 8 EO, $C_{12-18}$ alcohols with 3 EO, 5 EO or 7 EO and mixtures thereof, such as mixtures of $C_{12-14}$ alcohol with 3 EO and $C_{12-18}$ alcohol with 7 EO. The degrees of ethoxylation given are statistical averages, which may be an integer or a fraction for any given product. Preferred alcohol ethoxylates have a narrow range homolog distribution (narrow range ethoxylates, NRE). In addition to these nonionic surfactants, fatty alcohols with more than 12 EO may also be used. Examples include tallow fatty alcohol with 14 EO, 25 EO, 30 EO or 40 EO. Nonionic surfactants containing EO and PO groups together in the molecule may also be used according to the invention. Block copolymers with EO-PO block units and/or PO-EO block units may also be used here, but EO-PO-EO copolymers and/or PO-EO-PO copolymers may also be used. Mixed alkoxylated nonionic surfactants in which EO and PO units are randomly distributed rather than having a block distribution may also be used. Such products are obtainable by simultaneous action of ethylene oxide and propylene oxide on fatty alcohols.

Furthermore, the nonionic surfactants may also be alkyl glycosides, in particular those of the general formula RO(G)x, in which R denotes a primary linear or methyl-branched aliphatic radical, in particular with methyl branching in position 2, with 8 to 22 carbon atoms, preferably 12 to 18 carbon atoms, and G is the symbol for a glycose unit with 5 to 6 carbon atoms, preferably glucose. The degree of oligomerization x, which indicates the distribution of mono-glycosides and oligoglycosides, may be any number between 1 and 10; x is preferably 1.2 to 1.4.

Another class of preferred nonionic surfactants, which are used either as the sole nonionic surfactant or in combination with other nonionic surfactants include alkoxylated, preferably ethoxylated or ethoxylated and propoxylated fatty acid alkyl esters, preferably with 1 to 4 carbon atoms in the alkyl chain, in particular fatty acid methyl esters.

Nonionic surfactants of the amine oxide type, e.g., N-coco-alkyl-N,N-dimethylamine oxide and N-tallow alkyl-N,N-dihydroxyethylamine oxide and the fatty acid alkanolamides may also be suitable. The amount of these nonionic surfactants is preferably no more than that of the alcohol alkoxylates, in particular no more than half thereof.

Additional suitable nonionic surfactants include polyhydroxy fatty acid amides of formula (VI)

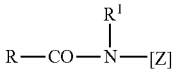

(VI)

in which R—CO stands for an aliphatic acyl radical with 6 to 22 carbon atoms, $R^1$ stands for hydrogen, an alkyl or hydroxylalkyl radical with 1 to 4 carbon atoms, and [Z] stands for a linear or branched polyhydroxyalkyl radical with 3 to 10 carbon atoms and 3 to 10 hydroxyl groups. The polyhydroxy fatty acid amides are known substances, which can usually be obtained by reductive amination of a reducing sugar with ammonia, an alkylamine or an alkanolamine and subsequent acylation with a fatty acid, a fatty acid alkyl ester or a fatty acid chloride. The group of polyhydroxy fatty acid amides also includes compounds of formula (VII)

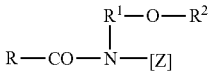

(VII)

in which R stands for a linear or branched alkyl or alkenyl radical with 7 to 12 carbon atoms, $R^1$ stands for a linear, branched or cyclic alkyl radical or an aryl radical with 2 to 8 carbon atoms, and $R^2$ stands for a linear, branched or cyclic alkyl radical or an aryl radical or an oxyalkyl radical with 1 to 8 carbon atoms, where $C_{1-4}$ alkyl or phenyl radicals are preferred, and [Z] stands for a linear polyhydroxyalkyl radical in which the alkyl chain is substituted with at least two hydroxyl groups, or alkoxylated, preferably ethoxylated or propoxylated derivatives of this radical. [Z] is preferably obtained by reductive amination of a sugar, e.g., glucose, fructose, maltose, lactose, galactose, mannose or xylose. N-Alkoxy-substituted or N-aryloxy-substituted compounds may then be converted into the desired polyhydroxy fatty acid amides by reacting them with fatty acid methyl esters in the presence of an alkoxide as the catalyst.

The nonionic surfactant content in the detergents, especially liquid detergents, preferably amounts to 5 wt % to 30 wt %, in particular 7 wt % to 20 wt % and especially preferably 9 wt % to 15 wt %, each based on the total agent. In a preferred embodiment, the nonionic surfactant is selected from alcohol alkoxylate and alkyl polyglycoside and mixtures thereof.

Examples of anionic surfactants that may be used include those of the sulfonate and sulfate type. Surfactants of the sulfonate type preferably include $C_{9-13}$ alkylbenzenesulfonates, olefinsulfonates, i.e., mixtures of alkenesulfonates and hydroxyalkanesulfonates and -disulfonates, such as those obtained, for example, from $C_{12-18}$ monoolefins with terminal or internal double bonds by sulfonation with gaseous sulfur trioxide and then alkaline or acidic hydrolysis of the sulfonation products. Alkanesulfonates obtained from $C_{12-18}$ alkanes, e.g., by sulfochlorination or sulfoxidation with subsequent hydrolysis and/or neutralization are also suitable. Likewise, the esters of α-sulfo fatty acids (ester sulfonates), e.g., the α-sulfonated methyl esters of hydrogenated coconut, palm kernel or tallow fatty acid are also suitable.

Sulfated fatty acid glycerol esters are additional suitable anionic surfactants. Fatty acid glycerol esters are understood to include the monoesters, diesters and triesters as well as mixtures thereof, such as those obtained in synthesis by esterification of a monoglycerol with 1 to 3 moles of fatty acid or in transesterification of triglycerides with 0.3 to 2 moles of glycerol. Preferred sulfated fatty acid glycerol esters are the sulfation products of saturated fatty acids with 6 to 22 carbon atoms, e.g., caproic acid, caprylic acid, capric acid, myristic acid, lauric acid, palmitic acid, stearic acid or behenic acid.

Preferred alk(en)yl sulfates include the alkali salts and in particular the sodium salts of sulfuric acid hemiesters of $C_{12}$-$C_{18}$ fatty alcohols, e.g., from coconut fatty alcohol, tallow fatty alcohol, lauryl, myristyl, cetyl or stearyl alcohol or of $C_{10}$-$C_{20}$ oxo alcohols and the hemiesters of secondary alcohols of these chain lengths. Also preferred are the alk(en)yl sulfates of the aforementioned chain length which have a synthetic linear alkyl radical or one synthesized on a petrochemical basis and having degradation properties similar to those of the adequate compounds based on raw materials from the chemistry of fats. The $C_{12}$-$C_{16}$ alkyl sulfates and $C_{12}$-$C_{15}$ alkyl sulfates as well as $C_{1-4}$-$C_{15}$ alkyl sulfates are preferred from a technical washing standpoint. Furthermore, 2,3-alkyl sulfates, which can be obtained as the commercial products of Shell Oil Company under the name DAN®, for example, are also suitable anionic surfactants.

The sulfuric acid monoesters of the alcohol alkoxylates mentioned above, e.g., the linear or branched $C_7$-$C_{21}$ alcohols ethoxylated with 1 to 6 moles of ethylene oxide, e.g., 2-methyl-branched $C_{9-11}$ alcohols with an average of 3.5 moles of ethylene oxide (EO) or $C_{12-18}$ fatty alcohols with 1 to 4 EO are also suitable. These are often also referred to as ether sulfates.

Additional suitable anionic surfactants also include the salts of alkyl sulfosuccinate acid, which are also known as sulfosuccinates or sulfosuccinic acid esters and represent the monoesters and/or diesters of sulfosuccinic acid with alcohols, preferably fatty alcohols, and in particular ethoxylated fatty alcohols. Preferred sulfosuccinates contain $C_{8-18}$ fatty alcohol radicals or mixtures thereof. Especially preferred sulfosuccinates contain a fatty alcohol radical derived from ethoxylated fatty alcohols, which are nonionic surfactants per se (for description, see below). Again, sulfosuccinates in which the fatty alcohol radicals are derived from ethoxylated fatty alcohols with a narrow homolog distribution are especially preferred. It is likewise possible to use alk(en)yl succinic acid with preferably 8 to 18 carbon atoms in the alk(en)yl chain or salts thereof.

Preferred anionic surfactants are soaps. Saturated and unsaturated fatty acid soaps are suitable, e.g., the salts of lauric acid, myristic acid, palmitic acid, stearic acid, (hydrogenated) erucaic acid and behenic acid and in particular soap mixtures derived from natural fatty acids, e.g., coconut, palm kernel, olive oil or tallow fatty acids. In a preferred embodiment, the detergent contains 2 wt % to 20 wt %, in particular 3 wt % to 15 wt % and especially preferably 5 wt % to 10 wt % fatty acid soap. Fatty acid soaps are an especially important ingredient for the detergency of a liquid detergent or cleaning agent, in particular an aqueous detergent and cleaning agent. It has surprisingly been found that when using the low-methylated carboxymethyl cellulose ether, clear and stable liquid detergents are obtained even in the presence of large amounts of fatty acid soap. The use of large amounts (≧2 wt %) of fatty acid soap in such systems usually leads to cloudy and/or unstable products.

The anionic surfactants, including the soaps, may be used in the form of their sodium, potassium or ammonium salts as well as the soluble salts of organic bases such as mono-, di- or triethanolamine. The anionic surfactants are preferably in the form of their sodium or potassium salts, in particular in the form of the sodium salts.

The anionic surfactant content of preferred detergents is 5 wt % to 35 wt %, in particular 8 wt % to 30 wt % and especially preferably 10 wt % to 25 wt %, each based on the total agent. It is especially preferable for the amount of fatty acid soap to be at least 2 wt %, especially preferably at least 3 wt %, and in particular 4 wt % to 10 wt %. In another preferred embodiment, the agents contain at least two, in particular three different anionic surfactants selected from alkylbenzenesulfonate, ether sulfate and fatty acid soap.

The detergent may contain a polyacrylate, which acts as a co-builder and optionally also as a thickener. These polyacrylates include polyacrylate or polymethacrylate thickeners, such as the high-molecular homopolymers of acrylic acid crosslinked with a polyalkylene polyether, in particular an allyl ether of sucrose, pentaerythritol or propylene (INCI designation according to the "International Dictionary of Cosmetic Ingredients" of The Cosmetic, Toiletry and Fragrance Association (CTFA): carbomer), which are also known as carboxyvinyl polymers. Such polyacrylic acids are available, for example, from the company 3V Sigma under the brand name Polygel®, e.g., Polygel® DA and from the company Noveon under the brand name Carbopol®, e.g., Carbopol® 940 (molecular weight approx. 4,000,000), Carbopol® 941 (molecular weight approx. 1,250,000) or Carbopol® 934 (molecular weight approx. 3,000,000). In addition, the following acrylic acid copolymers also fall under this classification: (i) copolymers of two or more monomers from the group of acrylic acid, methacrylic acid and their simple esters, preferably formed with $C_{1-4}$ alkanols (INCI: acrylates copolymer) which include, for example, the copolymers of methacrylic acid, butyl acrylate and methyl methacrylate (CAS designation according to Chemical Abstracts Service 25035-69-2) or copolymers of butyl acrylate and methyl methacrylate (CAS 25852-37-3) and which are available, for example, from the company Rohm & Haas under the brand names Aculyn® and Acusol® as well as from the company Degussa (Goldschmidt) under the brand name Tego® polymer, e.g., the anionic non-associative polymers Aculyn® 22, Aculyn® 28, Aculyn® 33 (crosslinked), Acusol® 810, Acusol®) 823 and Acusol® 830 (CAS 25852-37-3); (ii) crosslinked high-molecular acrylic acid copolymers, which include, for example, the copolymers of $C_{10-30}$ alkyl acrylates (with one or more monomers from the group of acrylic acid, methacrylic acid) crosslinked with an allyl ether of sucrose or pentaerythritol, and their simple esters, preferably formed with $C_{1-4}$ alkanols (INCI: acrylates/C10-30 alkyl acrylate crosspolymer) and are available, for example, from the company Noveon under the brand name CARBOPOL, e.g., the hydrophobized CARBOPOL ETD 2623 and CARBOPOL 1382 (INCI acrylates/C10-30 alkyl acrylate crosspolymer) as well as CARBOPOL Aqua 30 (previously CARBOPOL EX 473). Preferred detergents, in particular those in liquid form, contain the polyacrylate in an amount of up to 5 wt %, in particular 0.1 wt % to 2.5 wt %. It is advantageous if the polyacrylate is a copolymer of an unsaturated mono- or dicarboxylic acid and one or more $C_1$-$C_{30}$ alkyl esters of (meth) acrylic acid.

The viscosity of liquid detergents and cleaning agents can be measured with the usual standard methods (e.g., Brookfield viscometer LVT-II at 20 rpm and 20° C., spindle 3) and is preferably in the range of 150 mPas to 5000 mPas. Preferred liquid agents have viscosities in the range of 500 mPas to 4000 mPas, but values in the range of 1000 mPas to 3500 mPas are especially preferred.

In addition, the detergents may also contain other ingredients to further improve their aesthetic properties and/or technical properties that pertain to applications. Preferred agents within the scope of the present invention contain one or more substances from the group of builders, bleaching agents, bleach activators, enzymes, electrolytes, pH adjusters, perfumes, perfume carriers, fluorescent agents, dyes, hydrotropes, foam inhibitors, additional antiredeposition agents or anti-grey compounds, optical brighteners, shrink preventives, wrinkle-proofing agents, dye transfer inhibitors, antimicrobial active ingredients, germicides, fungicides, antioxidants, corrosion inhibitors, antistatics, ironing aids, phobicizing and impregnating agents, swelling and non-slip agents as well as UV absorbers.

Builders which may be present in the agents include, for example, aluminosilicate (in particular zeolites), carbonates, salts of organic di- and polycarboxylic acids and mixtures of these substances.

The fine crystalline synthetic zeolite containing bound water that may be used here is preferably zeolite A and/or P. Zeolite P is especially preferably Zeolite MAP® (commercial product of the company Crosfield). However, zeolite X and mixtures of A, X and/or P are also suitable. For example, a cocrystallizate of zeolite X and zeolite A (approx. 80 wt % zeolite X), which is distributed by the company SASOL under the brand name VEGOBOND AX® and can be described by the following formula is also commercially available and is preferably used within the scope of the present invention:

$$nNa_2O.(1-n)K_2O.Al_2O_3.(2\text{-}2.5)SiO_2.(3.5\text{-}5.5)H_2O$$

where n=0.90-1.0. This zeolite may be used in the form of a spray-dried powder or, especially in water-based liquid media, also as an undried stabilized suspension, which is still moist from synthesis. For the case when the zeolite is used as a suspension, it may contain small amounts of nonionic surfactants as stabilizer additives, e.g., 1 to 3 wt %, based on the zeolite, ethoxylated $C_{12}$-$C_{18}$ fatty alcohols with 2 to 5 ethylene oxide groups, $C_{12}$-$C_{14}$ fatty alcohols with 4 to 5 ethylene oxide groups or ethoxylated isotridecanols. Suitable zeolites have an average particle size of less than 10 μm (volume distribution; measurement method: Coulter counter) and preferably contain 18 to 22 wt %, in particular 20 wt % to 22 wt % bound water.

It is also possible to use the phosphates that are known in general as builder substances, if such a use is not to be avoided for ecological reasons. In particular the sodium salts of orthophosphates, pyrophosphates and especially the tripolyphosphates are suitable.

The enzymes that may be used include in particular those from the classes of hydrolases such as proteases, esterases, lipases and/or lipolytic enzymes, amylases, cellulases and/or other glycosyl hydrolases and mixtures of the aforementioned enzymes. All these hydrolases contribute toward spot removal, such as spots containing protein, fat or starch and contribute toward greying when used in the wash. Cellulases and other glycosyl hydrolases may also contribute toward color preservation and toward increasing the softness of a textile by removing pilling and microfibrils. Oxireductases may also be used for bleaching and/or for inhibiting dye transfer. Enzymatic active ingredients obtained from bacterial strains or fungi such as *Bacillus subtilis, Bacillus licheniformis, Streptomyces griseus* and *Humicola insolens* are especially suitable. Proteases of the subtilisin type, and in particular proteases obtained from *Bacillus lentus*, are preferred for use here. Enzyme mixtures, e.g., of protease and amylase or protease and lipase and/or lipolytic enzymes or protease and cellulase or cellulase and lipase and/or lipolytic enzymes or from protease, amylase and lipase and/or lipolytic enzymes or protease, lipase and/or lipolytic enzymes and cellulase, in particular, however, protease and/or lipase-containing mixtures and/or mixtures with lipolytic enzymes are of particular interest. Examples of such lipolytic enzymes include the known cutinases. Peroxidases or oxidases have proven to be suitable in some cases. The suitable amylases include in particular α-amylases, isoamylases, pullulanases and pectinases. Cellobiohydrolases, endoglucanases and β-glucosidases, also known as cellobiases, and/or mixtures of these are preferably used as the cellulases. Since various types of cellulase are differentiated based on their CMCase and avicelase activities, the desired activities can be adjusted through targeted mixtures of cellulases.

The enzymes may be adsorbed onto carrier substances and/or sheathed in them to protect them from premature decomposition. The amount of enzymes, enzyme liquid formulations, enzyme mixtures or enzyme granules may be, for example, approx. 0.1 wt % to 5 wt %, preferably 0.12 wt % to approx. 2.5 wt %, each based on the total agent.

A large number of a wide variety of salts may be used as the electrolytes from the inorganic salt group. Preferred cations include alkali and alkaline earth metals; preferred anions are the halides and sulfates. From a technical manufacturing standpoint, the use of NaCl or $MgCl_2$ in the agents is preferred. The amount of electrolytes in the agents, especially liquid, usually amounts to no more than 8 wt %, in particular 0.5 wt % to 5 wt %.

To adjust the pH of liquid agents to the desired range, the use of pH adjusting agents may be indicated. All known acids and/or bases may be used here if their use is not prohibited for ecological reasons, technical reasons based on applications and/or consumer protection reasons. The amount of these adjusting agents preferably does not exceed 10 wt % of the total formulation.

Another component of inventive liquid agents that may be present, if desired, is a hydrotrope. Preferred hydrotropes comprise the sulfonated hydrotropes, for example, the alkylarylsulfonates or alkylarylsulfonic acids. The preferred hydrotropes are selected from xylene, toluene, cumene, naphthalene-sulfonate or -sulfonic acid and mixtures thereof. Counterions are preferably selected from sodium, calcium and ammonium. If necessary, the liquid agents may contain up to 20 wt % of a hydrotrope, in particular 0.05 wt % to 10 wt %.

To improve the aesthetic impression of the agents, they or at least one of their components may be colored with suitable dyes. Those skilled in the art will not have any difficulty in selecting preferred dyes, which have a great stability in storage and are insensitive to the other ingredients of the agents as well as being insensitive to light and not having a marked substantivity with respect to textile fibers so as not to stain them.

Examples of foam inhibitors that may be used in the detergents and cleaning agents include soaps, paraffins or silicone oils, which may optionally also be applied to carrier materials.

Suitable antiredeposition agents, also known as "soil repellents" are the polymers of phthalic acid and/or terephthalic and/or their derivatives that are known from the prior art, in particular polymers of ethyleneterephthalates and/or polyethylene glycol terephthalates or anionically and/or nonionically modified derivatives thereof. Of these, the sulfonated derivatives of phthalic acid and terephthalic acid polymers are especially preferred.

Optical brighteners may be added to the detergents and cleaning agents to eliminate yellowing of the treated textile fabrics. These substances are absorbed onto the fibers and cause brightening by converting ultraviolet radiation, which is invisible to the human eye, into visible light of a longer wavelength by emitting the ultraviolet light absorbed from the sunlight as a faintly bluish fluorescence and, with the yellow tone of yellowed laundry, yielding pure white. Suitable compounds originate, for example, from the substance classes of 4,4'-diamino-2,2'-stilbenedisulfonic acids (flavonic acids), 4,4'-distyrylbiphenylene, methylumbelliferones, coumarins, dihydro-quinolinones, 1,3-diarylpyrazolines, naphthalic acid imides, benzoxazole, benzisoxazole and benzimidazole systems as well as pyrene derivatives substituted by heterocycles. Optical brighteners are normally used in amounts up to 0.5 wt %, in particular 0.03 wt % to 0.3 wt %, based on the finished agent.

Textile fabrics, in particular those of rayon, rayon staple, cotton and blends thereof, may tend to wrinkle, because the individual fibers are sensitive to bending, folding, pressing and squeezing across the direction of the fiber, so the agents may contain synthetic antiwrinkle agents. These include, for example, synthetic products based on fatty acids, fatty acid esters, fatty acid amides and alkylol esters, alkylolamides or fatty alcohols, usually reacted with ethylene oxide, or products based on lecithin or modified phosphoric acid esters.

To combat microorganisms, the detergents and cleaning agents may contain antimicrobial active ingredients. A distinction is made between bacteriostatics and bactericides, fungistatics and fungicides, etc., depending on the antimicrobial spectrum and mechanism of action. Important substances from these groups include, for example, benzalkonium chlorides, alkylaryl-sulfonates, halophenols and phenol mercuriacetate, but these compounds may also be omitted entirely in the inventive agents.

The agents may contain antioxidants to prevent unwanted changes in the detergents and cleaning agents and/or the textile fabrics treated with them, where said changes are caused by the action of oxygen and other oxidative processes. This class of compounds includes, for example, substituted phenols, hydroquinones, pyrocatechols and aromatic amines as well as organic sulfides, polysulfides, dithiocarbamates, phosphates and phosphonates. When using such antioxidants, the inventive agents are free of oxidizing bleaching agents.

Increased wearing comfort may be the result of the additional use of antistatics which are additionally added to the agents. Antistatics increase the surface conductivity and thus allow the charges that are formed to flow off more readily. External antistatics are usually substances with at least one hydrophilic molecular ligand and form a more or less hygroscopic film on the surfaces. These antistatics, usually with a surfactant action, can be subdivided into antistatics containing nitrogen (amines, amides, quaternary ammonium compounds), antistatics containing phosphorus (phosphoric acid esters) and those containing sulfur (alkyl sulfonates, alkyl sulfates). External antistatics include, for example, lauryl (and/or stearyl) dimethylbenzylammonium chlorides, which are suitable as antistatics for textile fabrics and/or as additives to detergents, where a finishing effect is also achieved.

Silicone derivatives, for example, may be used in the detergents and cleaning agents to improve the water absorption capacity, the rewettability of the treated textile fabrics and to facilitate ironing of the treated textile fabrics. They additionally improve the rinse-out behavior of the agents through their foam suppressing properties. Preferred silicone derivatives include, for example, polydialkyl- or alkylarylsiloxanes, in which the alkyl groups have 1 to 5 carbon atoms and are entirely or partially fluorinated. Preferred silicones include polydimethylsiloxanes, which may optionally be derivatized and then are amino-functional or quaternated and/or have Si—OH, Si—H and/or Si—Cl bonds. The viscosities of the preferred silicones are in the range between 100 mPas and 100,000 mPas at 25° C., where the silicones may be used in amounts between 0.2 and 5 wt %, based on the total agent.

Finally, the detergents and cleaning agents may also contain UV absorbers, which are absorbed onto the treated textile fabrics and improve the light stability of the fibers. Compounds having these desired properties include, for example, compounds and derivatives of benzophenone with substituents in positions 1 and/or 2, which are active by radiationless deactivation. In addition, substituted benzotriazoles, acrylates with a phenyl substituent in position 3 (cinnamic acid derivatives), optionally with cyano groups in position 2, salicylates, organic nickel complexes and natural substances such as umbelliferone and urocanic acid are also suitable.

To prevent heavy-metal-catalyzed decomposition of certain detergent ingredients, substances that chelate heavy metals may be used. Suitable heavy metal chelating agents include, for example, the alkali salts of ethylene-diaminetetraacetic acid (EDTA) or nitrilotriacetic acid (NTA) as well as alkali metal salts of anionic polyelectrolytes, such as polymaleates and polysulfonates.

The phosphonates, which are present in preferred agents in amounts of 0.01 wt % to 2.5 wt %, preferably from 0.02 wt % to 2 wt % and in particular from 0.03 wt % to 1.5 wt %, are a preferred class of chelating agents. These preferred compounds include in particular organophosphonates such as 1-hydroxyethane-1,1-diphosphonic acid (HEDP), aminotri (methylene phosphonic acid) (ATMP), diethylenetriamine-penta(methylenephosphonic acid) (DTPMP or DETPMP) as well as 2-phosphonobutane-1,2,4-tricarboxylic acid (PBSAM), which are usually used in the form of their ammonium or alkali metal salts.

Inventive liquid detergents are preferably clear, i.e., they do not have any sediment and they are usually transparent or at least translucent. Without the addition of a dye, the liquid detergents and cleaning agents preferably have a visible light transmission (410 to 800 nm) of at least 30%, preferably at least 50% and in particular preferably at least 75%.

Aqueous detergents and cleaning agents can be produced easily and inexpensively in conventional mixing and filling systems. To produce the liquid agents, if present, the acid components, e.g., the linear alkylsulfonates, citric acid, boric acid, phosphonic acid, the fatty alcohol ether sulfates and the nonionic surfactants are preferably placed first. The solvent component is preferably also added at this time, but this addition may also take place at a later point in time. If present, the chelating agent is added to these components. Then a base such as NaOH, KOH, triethanolamine or monoethanolamine is added, followed by fatty acid, if present. Then the remaining ingredients and optionally the remaining solvents of the aqueous liquid agent are added to the mixture, and the pH is adjusted to the desired value. In conclusion, if desired, the particles to be dispersed may be added and distributed homogeneously in the aqueous liquid agent by mixing.

EXAMPLES

Table 1 shows the composition (ingredients in percent by weight, wt %, each based on the total agent) of an inventive detergent M1.

TABLE 1

| | M1 |
|---|---|
| $C_{9-13}$ alkylbenzenesulfonate sodium salt | 10 |
| Sodium lauryl ether sulfate with 2 EO | 5 |
| $C_{12-18}$ fatty alcohol with 7 EO | 10 |
| $C_{12-14}$ alkyl polyglycoside | 2 |
| $C_{12-18}$ fatty acid sodium salt | 8 |
| Glycerol | 5 |
| Trisodium citrate | 1 |
| Polyacrylate | 2 |
| Active ingredient | 1 |
| Enzyme, dye, optical brightener | + |
| Water | to 100 |

The agent was tested under the following conditions:

| | |
|---|---|
| Washing device: | Washing machine |
| Washing temperature: | 40° C. |
| Number of washings: | 10 |
| Water hardness: | 16° dH |
| Soil carrier: | 6.7 g mixed soil (e.g., loam, dust, skin oil, soot) |
| Dosage: | 75 g of the agent/17 liters |

The following materials were used

A Polyester/cotton blends

B 100% cotton

C 100% cotton, terry cloth

D 100% cotton, cotton knit

The use of the active ingredient according to the present invention yields an improvement in the anti-grey effect on all materials in comparison with an agent having otherwise the same composition but lacking the active ingredient.

What is claimed is:

1. A detergent comprising 10 wt % to 60 wt % of at least one surfactant comprising an anionic surfactant and at least one polycarbonate-, polyurethane- or polyurea-polyorganosiloxane compound containing at least one structural element of Formula (I):

$$—Y-A-(C{=}O)-A- \quad (I)$$

where each A is selected, independently, from S, O or $NR^1$;

Y is a divalent or polyvalent, linear, cyclic or branched, saturated, unsaturated or aromatic, substituted or unsubstituted hydrocarbon radical with up to 1000 carbon atoms (not counting the carbon atoms of a polyorganosiloxane unit that is optionally also present), which may contain one or more groups selected from —(CO)—, —NH—, $—NR^2—$, $—(N^+R^2R^3)—$ or a polyorganosiloxane unit with 2 to 1000 silicon atoms;

$R^1$ is hydrogen or a linear, cyclic or branched, saturated, unsaturated or aromatic hydrocarbon radical with up to 40 carbon atoms, which may contain one or more groups selected from —O—, —(CO)—, —NH— or $—NR^2—$;

$R^2$ is a linear, cyclic or branched, saturated, unsaturated or aromatic hydrocarbon radical with up to 40 carbon atoms, which may contain one or more groups selected from —O—, —(CO)— or —NH—;

$R^3$ is a linear, cyclic or branched, saturated, unsaturated or aromatic hydrocarbon radical with up to 100 carbon atoms, which may contain one or more groups selected from —O—, —(CO)——or —NH— or is a divalent radical which forms a cyclic structure within the radical Y, or one or both radicals A vicinal to Y together with the radical Y between them may form a heterocyclic radical containing nitrogen, and not all the radicals A and/or Y and/or $R^1$ and/or $R^2$ and/or $R^3$ indicated in Formula (I) must be the same in the entire compound, with the provision that at least one of the radicals Y in the entire compound is a polyorganosiloxane unit with 2 to 1000 silicon atoms and/or the acid addition compound and/or salt thereof.

2. The detergent according to claim 1, wherein the polyorganosiloxane unit present in the polycarbonate-, polyurethane- and/or polyurea-polyorganosiloxane compound has a structure $—(R^4{}_2SiO)_p—(SiR^4{}_2)—$, where $R^4$ is a linear, cyclic or branched, saturated, unsaturated or aromatic hydrocarbon radical with up to 20 carbon atoms and p =1 to 999.

3. The detergent according to claim 1, wherein the polycarbonate-, polyurethane- and/or polyurea-polyorganosiloxane compound in the detergent contains at least two polyorganosiloxane units.

4. The detergent according to claim 1, wherein at least one of the Y units according to the structural element of Formula (I) in the polycarbonate-, polyurethane-and/or polyurea-polyorganosiloxane compound has a group $—NR^2—$and/or at least one of the Y units according to the structural element of Formula (I) has a group $—(N^+R^2R^3)—$.

5. The detergent according to claim 1, wherein oligoethoxy and/or oligopropoxy groups are present in at least one of the units $R^1$, $R^2$ and/or $R^3$ according to the structural element of. Formula (I), such oligoethoxy and/or oligopropoxy groups having degrees of oligomerization in the range of 2 to 60.

6. The detergent according to claim 1, wherein oligoethylene-imine groups having degrees of oligomerization in the range of 10 to 150,000 are present in at least one of the units Y, $R^1$, $R^2$ and/or $R^3$ according to the structural element of Formula (I).

7. The detergent according to claim 1, wherein the polycarbonate- and/or polyurethane- polyorganosiloxane compound contains at least one structural element of Formula (II) or Formula (III):

$$-A-Y-A-(CO)—O—Z—(CHOH)—Z—O—(CO)— \quad (II)$$

$$-A-Y-A-(CO)—O—(CHCH_2OH)—Z—O—(CO)— \quad (III)$$

in which A and Y have the meanings as in claim 1 and

Z is a divalent, linear cyclic or branched, saturated or unsaturated, optionally substituted hydrocarbon radical with 1 to 12 carbon atoms.

8. The detergent according to claim 1 further, comprising a nonionic surfactant.

9. The detergent according to claim 1, comprising 0.01 wt % to 5 wt % of the at least one polycarbonate-, polyurethane- or polyurea-polyorganosiloxane compound and/or acid addition compound and/or salt thereof.

10. The detergent according to claim 1, wherein the detergent is liquid and contains up to 85 wt % water.

11. A method of washing a textile fabric, comprising contacting the textile fabric with the detergent of claim 1.

* * * * *